US006726318B2

(12) United States Patent
Arakawa

(10) Patent No.: US 6,726,318 B2
(45) Date of Patent: Apr. 27, 2004

(54) MICROSCOPIC DROPLET DETECTING DEVICE AND INK-JET RECORDING APPARATUS

(75) Inventor: Hiroaki Arakawa, Yamanashi (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/302,344

(22) Filed: Nov. 22, 2002

(65) Prior Publication Data

US 2003/0103131 A1 Jun. 5, 2003

(30) Foreign Application Priority Data

Nov. 30, 2001 (JP) ..... 2001-367774
Oct. 28, 2002 (JP) ..... 2002-312402

(51) Int. Cl.[7] ..... B41J 3/407; B41J 29/393; B41J 2/125

(52) U.S. Cl. ..... 347/106; 347/19; 347/81

(58) Field of Search ..... 347/19, 23, 42, 347/163, 166, 106, 130, 131, 134, 135, 81

(56) References Cited

U.S. PATENT DOCUMENTS

| | | | | | |
|---|---|---|---|---|---|
| 4,509,057 | A | * | 4/1985 | Sohl et al. | 347/19 |
| 5,430,306 | A | * | 7/1995 | Ix | 347/19 |
| 5,627,571 | A | * | 5/1997 | Anderson et al. | 347/19 |
| 6,062,668 | A | * | 5/2000 | Cruz-Uribe | 347/19 |
| 6,419,341 | B1 | * | 7/2002 | Nohata et al. | 347/19 |
| 6,467,328 | B1 | * | 10/2002 | Kalkum et al. | 73/1.01 |
| 6,517,183 | B2 | * | 2/2003 | Bruch et al. | 347/19 |

* cited by examiner

*Primary Examiner*—Stephen D. Meier
*Assistant Examiner*—An H. Do
(74) *Attorney, Agent, or Firm*—Frishauf, Holtz, Goodman & Chick, P.C.

(57) ABSTRACT

A microscopic droplet detecting device for detecting a passage of droplets jetted from a nozzle of an ink jetting device, including a droplet detecting section including a paired light emitting and receiving elements, a jet control section to control the ink jetting device to jet droplets serially along the traveling course, and a jetting condition detecting section to detect a jetting condition of the nozzle based on the output signal.

22 Claims, 14 Drawing Sheets

FIG. 2 ( a )
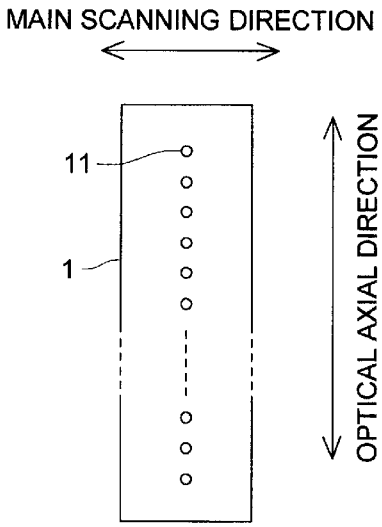
FIG. 2 ( b )
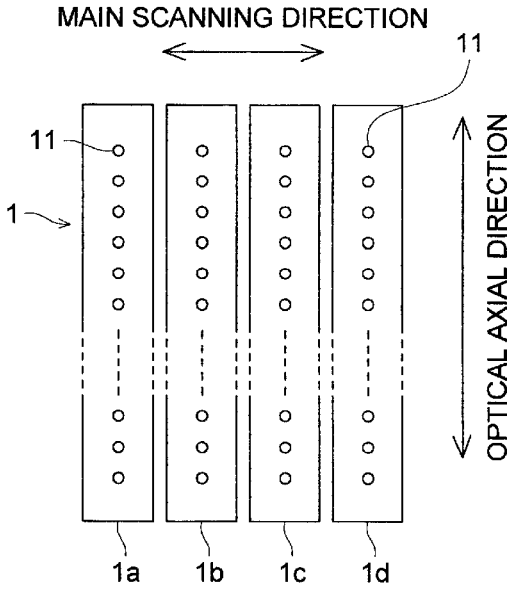
FIG. 2 ( c )
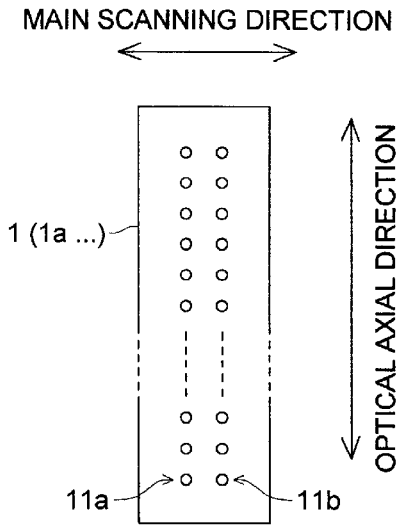

FIG. 13

202a

| COLOR OF INK | NUMBER OF DROPLETS |
|---|---|
| DARK Y | 6 |
| DARK M | 5 |
| DARK C | 4 |
| DARK K | 3 |
| LIGHT Y | 10 |
| LIGHT M | 8 |
| LIGHT C | 7 |
| LIGHT K | 6 |

MICROSCOPIC DROPLET DETECTING DEVICE AND INK-JET RECORDING APPARATUS

BACKGROUND OF THE INVENTION

The present invention relates to a device for detecting microscopic droplets which detects a jetting condition of droplets jetted from a nozzle that jets microscopic droplets, and an ink-jet recording apparatus using the same.

In an ink-jet recording apparatus which jets microscopic droplets from a nozzle provided on a recording head on a recording medium for image recording, a jetting condition of ink is detected by the detection of an absence/presence of jetting of an ink droplet (hereinafter referred to as a droplet) from each nozzle, or by the detection of a flying speed of the jetted droplet, before the performance of an image recording, however, since the jetted droplet becomes further microscopic by the improvement of image quality in terms of a printing accuracy in the present years, the microscopic droplet not greater than 4 pico-liter must be detected, today.

In the past, in order to detect the jetting condition of the droplet, a detecting section that is composed of a light emitting element and a light receiving element is provided to cross a traveling course of the droplet, and a shadow against the detecting light representing a piece of droplet passing through between the light emitting element and the light receiving element on the optical axis is received by the light receiving element, and then, a change of amount of light caused by the shadow is detected and amplified, and thereby, the presence of the ink-jet from the nozzle is detected, in the case of detecting the presence/absence of the jetting, for example. However, due to the tendency that the droplet becomes more microscopic in the future and the image quality becomes higher, the shadow of the more microscopic droplet in a size of about ten-odd $\mu$m must be detected and its faint signal must be amplified, which causes the fear that correct detection will become difficult due to the deterioration of S/N ratio.

For the measure, a laser diode is used for a light source of the light emitting element so that the light amount per unit area becomes large, or a lens is dropped down when an LED is used for the light source so that the detecting area is stopped down as far as possible, and thereby, it is conceivable that the S/N ratio is improved by making the shadow of the droplet caught by the detecting section to be larger relatively, compared to the detecting area. However, since a carriage moves in the scanning direction, an accuracy for stopping the recording head is requested more and more severely so that the droplet jetted from the nozzle of the recording head may pass through on the optical axis between the light emitting element and the light receiving element, in order to stop the recording head accurately. To improve the stopping accuracy, the higher performance of a motor driving servo including the detection of the position is requested, which causes not only the cost increase but also the deterioration of the total detecting accuracy, caused by the malfunction of the detection owing to the shift of the stopping position.

With the foregoing as a background, there has been proposed a technology wherein the area covered by the droplet in the detecting area that is detectable by the light receiving element is made to be larger so that the microscopic droplet can be detected (Patent document 1), by the manner that a jetting interval in detecting the jetting of the droplet is established to be shorter than the jetting interval in operating the normal printing, or by the manner that a jetting amount of the droplet per unit time in detecting the jetting of the droplet is established to be larger than the jetting amount of the droplet per unit time in operating the normal printing.

(Patent document 1) Japanese TOKKAIHEI 11-78051

However, when the droplets are jetted continuously, there is a following problem, which clears that an appropriate detection cannot be conducted. That is, when the droplet pass through the detection area of the light receiving element, though the change of the amount of light received by the light receiving element is detected, there occurs the condition that the amount of light when the droplets are passing through hardly changes in the technology described in the above-mentioned patent document. Due to this, even if the output signal from the light receiving element is amplified, it is difficult to select only the signal of the changed value of the light amount from the noise component, causing a problem of miss detection, being impossible to obtain a detecting signal having better S/N ratio.

Further, since the droplet is detected optically by the light receiving element, it often comes under the influence of disturbance light in the course of the detecting operation, and S/N ratio of the detected signal is declined by this influence, causing a problem of miss detection.

Still further, there is a case that the light amount detected by the light receiving element varies depending on the type of the droplet such as the difference of color of ink. In such a case, there is a fear of miss detection due to the difference of the sensitivity of the light receiving element for each type of the ink, accordingly, it is desired that the sensitivity is easily adjustable.

SUMMARY OF THE INVENTION

Accordingly, the first subject of the present invention is to provide a microscopic droplet detecting device and an ink-jet recording apparatus which can perform, with high S/N ratio, the detection of the jetting condition of the droplets from the nozzle, by discriminating clearly the optical detection and non-detection of the droplets jetted from the nozzle.

Further, the second subject of the present invention is to provide a microscopic droplet detecting device and an ink-jet recording apparatus which can perform, with high S/N ratio, the detection of the jetting condition of the droplets from the nozzle without coming under the influence of the environmental noise such as the disturbance light.

Still further, the third subject of the present invention is to provide a microscopic droplet detecting device and an ink-jet recording apparatus which can always detect the droplets with the stable sensitivity, independently of the type of the droplets.

The above-mentioned matters are solved by the following Structures.

Structure 1 is a microscopic droplet detecting device for detecting the passage of droplets jetted from a nozzle, having therein, a droplet detecting section in which a light emitting element and a light receiving element are arranged to cross over a traveling course of the droplet jetted from the nozzle and the plural droplets can exist in the distance in the traveling direction of the droplets within the detecting limit of the detecting light emitted from the light emitting element to the light receiving element, a jet control section for controlling a jetting of a group of the droplets composed of the plural and continuous droplets which are jetted from the nozzle, and a jetting condition detecting section for detecting the jetting condition of the droplets from the nozzle, based on the output signal which is obtained by detecting the droplets group controlled by the jet control section by the droplet detecting section, wherein the jet controlling section provides a suspension period in which the droplet is not jetted between a preceding group of serial droplets and a following group of serial droplets which are measured by the droplet detecting section, and wherein when the suspension period is represented by β, a distance along the traveling direction of the group of serial droplets (hereinafter referred to as the droplets group) within the detecting limit of the droplet detecting section is represented by L (m), and a speed of the droplets for passing through the detecting limit of the droplet detecting section is represented by V (m/sec), the condition expressed by $\beta \geqq L/V$ is satisfied.

In Structure 1, by providing the suspension period β so as to satisfy the above-mentioned condition, the distance between the droplets group having passed through the detecting limit of the droplet detecting section in first and the next droplets group having passed through is greater than distance L representing the distance along the traveling direction of the droplets within the detecting limit of the droplet detecting section, and due to this, even when the droplets groups are jetted continuously from the same nozzle or the different nozzle, a group of serial droplets passes through the detecting limit of the droplet detecting section, one by one, and an output signal from the light receiving element is obtained as a single combined signal, and due to this, the output signal from the light receiving element can discriminate the detecting condition by passing of a serial droplets group from the non-detecting condition of the suspension period clearly, by which a noise component is easily eliminated by a high pass filter, thus, it is possible to obtain the microscopic droplet detecting device that can take out only the detecting signal having a better S/N ratio.

Structure 2 is the microscopic droplet detecting device described in Structure 1, wherein β satisfies the condition $5\ \mathrm{m\ sec} \geqq \beta$.

In Structure 2, since the suspension period β satisfies the above-mentioned condition, the influence caused by the disturbance light existing in the vicinity of 200 Hz or by noise from the power supply can be reduced, and it is possible to conduct the detection having a better S/N ratio, accordingly.

Structure 3 is a microscopic droplet detecting device described in Structure 1, wherein when αn represents the time obtained by dividing the distance between a center of a top droplet and a center of a last droplet which compose a droplets group with an average speed of the droplet, αn satisfies the following formula.

$$5\ \mathrm{m\ sec} \geqq \alpha n \geqq 0.5L/V$$

In Structure 3, when αn is in the aforementioned limit, an influence of a noise is less and a sufficient signal output can be obtained.

Structure 4 is the microscopic droplet detecting device described in Structure 1, wherein the jet control section can change the number of the droplets which compose the droplets group.

Structure 4 can adjust the sensitivity of the light receiving element, when the droplets group passes through the detecting limit of the droplet detecting section, and can also keep up easily with a further down sizing of the droplet that is expected in future.

Structure 5 is a microscopic droplet detecting device for detecting the passage of droplets jetted from a nozzle, having therein, a droplet detecting section in which a light emitting element and a light receiving element are arranged to cross over a traveling course of the droplet jetted from the nozzle and the plural droplets can exist in the distance in the traveling direction of the droplets within the detecting limit of the detecting light emitted from the light emitting element to the light-receiving element, a jet control section for controlling a jetting of the droplets group composed of the plural and continuous droplets which are jetted from the nozzle, and a jetting condition detecting section for detecting the jetting condition of the droplets from the nozzle, based on the output signal which is obtained by detecting the droplets group controlled by the jet control section by the droplet detecting section, wherein, wherein when αn represents the time obtained by dividing the distance between a center of a top droplet and a center of a last droplet which compose a droplet group with an average speed of the droplet, αn satisfies the following formula.

$$5\ \mathrm{m\ sec} \geqq \alpha n \geqq 0.5L/V$$

Structure 5 can make the microscopic droplet detecting device which is hardly influenced by a disturbance light existing in the vicinity of 200 Hz and by noise from power supply and is able to obtain the sufficient signal output in the light receiving element.

Structure 6 is the microscopic droplet detecting device described in Structure 5, wherein the above-mentioned jet control section can change the number of the droplets which compose the droplets group.

Structure 6 can adjust the sensitivity of the light receiving element, when the droplets group passes through the detecting limit of the droplet detecting section, and can also keep up easily with a further down sizing of the droplet that is expected in future.

Structure 7 is the microscopic droplet detecting device for detecting the passage of droplets jetted from a nozzle, having therein, a droplet detecting section in which a light emitting element and a light receiving element are arranged to cross over a traveling course of the droplet jetted from the nozzle and the plural droplets can exist in the distance in the traveling direction of the droplets within the detecting limit of the detecting light emitted from the light emitting element to the light receiving element, a jet control section for controlling a jetting of the droplets group composed of the plural and continuous droplets which are jetted from the nozzle, and a jetting condition detecting section for detecting the jetting condition of the droplets from the nozzle, based on the output signal which is obtained by detecting the droplets group controlled by the jet control section by the droplet detecting section, wherein the jet control section can change the number of the droplets which compose the droplets group.

Structure 7 can adjust the sensitivity of the light receiving element, when the droplets group passes through the detecting limit of the droplet detecting section, and can also keep up easily with a further down sizing of the droplet that is expected in future.

Structure 8 is the microscopic droplet detecting device described in Structure 4, wherein the above-mentioned jet controlling section changes the number of the droplets which compose a droplets group, in accordance with the level of the output signal that is detected by the droplet detecting device.

Structure 8 can establish the more appropriate number of the droplets.

Structure 9 is the microscopic droplet detecting device described in Structure 4, 6 or 7, wherein the jet controlling means changes the number of the droplets which compose a droplets group, in accordance with the type of the microscopic droplets.

Structure 9 can obtain the stably detected output independently of the type of the microscopic droplet so that the invention can always conduct the correct detecting operation.

Structure 10 is the microscopic droplet detecting device described in Structure 9 having therein a discriminating section for discriminating the type of the microscopic droplet jetted from the nozzle, wherein the above-mentioned jet control section changes the number of the droplets which compose a droplets group, in accordance with the type of the microscopic droplet that is discriminated by the discriminating section.

Structure 10 can automatically control the change of the number of the droplets, in accordance with the type of the microscopic droplet.

Structure 11 is the microscopic droplet detecting device described in Structure 9 having therein a table in which the relationship between the type of the microscopic droplet and the number of the droplets composing a droplets group according to the type is memorized in advance, wherein the above-mentioned jet controlling section changes the number of the droplets which compose a droplets group, in accordance with the table.

Structure 11 can quickly determine the proper number of the droplets, in accordance with the type of the microscopic droplets.

Structure 12 is the microscopic droplet detecting device described in Structure 9, wherein the type of the above-mentioned microscopic droplets is either one of a color, density, viscosity, temperature characteristics, and composition of the microscopic droplet.

Structure 12 can control the proper number of the droplets from the various view points of the microscopic droplet to change the number so that the more correct detecting operation can be conducted.

Structure 13 is an ink-jet recording apparatus that conducts the recording on a recording medium by jetting microscopic droplets of ink from a nozzle of a recording head, having therein, a droplet detecting section in which a light emitting element and a light receiving element are arranged to cross over a traveling course of the droplet jetted from the nozzle and the plural droplets can exist in the distance in the traveling direction of the droplets within the detecting limit of the detecting light emitted from the light emitting element to the light receiving element, a jet control section for controlling a jetting of the droplets group composed of the plural and continuous droplets which are jetted from the nozzle, and a jetting condition detecting section for detecting the jetting condition of the droplets from the nozzle, based on the output signal which is obtained by detecting the droplets group controlled by the jet control section by the droplet detecting section, wherein the jet controlling section provides a suspension period in which the droplet is not jetted between a preceding group and a following group which are measured by the droplet detecting section, and wherein when the suspension period is represented by $\beta$, a distance along the traveling direction of the droplets group within the detecting limit of the droplet detecting section is represented by L (m), and a speed of the droplets for passing through the detecting limit of the droplet detecting section is represented by V (m/sec),
the condition expressed by $\beta \geqq L/V$ is satisfied.

In Structure 13, by providing the suspension period $\beta$ so as to satisfy the above-mentioned condition, the distance between the droplets group having passed through the detecting limit of the droplet detecting section in first and the next droplets group having passed through is greater than distance L representing the distance along the traveling direction of the droplets within the detecting limit of the droplet detecting section, and due to this, even when the droplets groups are jetted continuously from the same nozzle or the different nozzle, a droplets group passes through the detecting limit of the droplet detecting section, one by one, and an output signal from the light receiving element is obtained as a single combined signal, and due to this, the output signal from the light receiving element can discriminate the detecting condition by passing of a droplets group from the non-detecting condition of the suspension period clearly, by which a noise component is easily eliminated by a high pass filter, thus, it is possible to obtain the ink-jet recording apparatus that can take out only the detecting signal having a better S/N ratio.

Structure 14 is the ink-jet recording apparatus described in Structure 1, wherein $\beta$ satisfies the condition 5 m sec$\geqq\beta$.

In Structure 14, since the suspension period $\beta$ satisfies the above-mentioned condition, the influence caused by the disturbance light existing in the vicinity of 200 Hz or by noise from the power supply can be reduced, and it is possible to conduct the detection having a better S/N ratio, accordingly.

Structure 15 is the ink-jet recording apparatus described in Structure 13, wherein when $\alpha n$ represents the time obtained by dividing the distance between a center of a top droplet and a center of a last droplet which compose a droplets group with an average speed of the droplet, $\alpha n$ satisfies the following formula.

$$5 \text{ m sec} \geqq \alpha n \geqq 0.5L/V$$

In Structure 15, when $\alpha n$ is in the aforementioned limit, an influence of a noise is less and a sufficient signal output can be obtained.

Structure 16 is the ink-jet recording apparatus described in Structure 13, wherein the jet control section can change the number of the droplets which compose the droplets group.

Structure 16 can adjust the sensitivity of the light receiving element, when the droplets group passes through the detecting limit of the droplet detecting section, and can also keep up easily with a further down sizing of the droplet that is expected in future.

Structure 17 is the ink-jet recording apparatus for detecting the passage of droplets jetted from a nozzle, having therein, a droplet detecting section in which a light emitting element and a light receiving element are arranged to cross over a traveling course of the droplet jetted from the nozzle and the plural droplets can exist in the distance in the traveling direction of the droplets within the detecting limit of the detecting light emitted from the light emitting element to the light receiving element, a jet control section for controlling a jetting of the droplets group composed of the plural and continuous droplets which are jetted from the nozzle, and a jetting condition detecting section for detecting the jetting condition of the droplets from the nozzle, based on the output signal which is obtained by detecting the droplets group controlled by the jet control section by the droplet detecting section, wherein, wherein when $\alpha n$ represents the time obtained by dividing the distance between a center of a top droplet and a center of a last droplet which compose a droplets group with an average speed of the droplet, an satisfies the following formula.

$$5 \text{ m sec} \geqq an \geqq 0.5L/V$$

Structure 17 can make the ink-jet recording apparatus which is hardly influenced by a disturbance light existing in the vicinity of 200 Hz and by noise from power supply and is able to obtain the sufficient signal output in the light receiving element.

Structure 18 is the ink-jet recording apparatus described in Structure 17, wherein the above-mentioned jet control section can change the number of the droplets which compose the droplets group.

Structure 18 can adjust the sensitivity of the light receiving element, when the droplets group passes through the detecting limit of the droplet detecting section, and can also keep up easily with a further down sizing of the droplet that is expected in future.

Structure 19 is the ink-jet recording apparatus for detecting the passage of droplets jetted from a nozzle, having therein, a droplet detecting section in which a light emitting element and a light receiving element are arranged to cross over a traveling course of the droplet jetted from the nozzle and the plural droplets can exist in the distance in the traveling direction of the droplets within the detecting limit of the detecting light emitted from the light emitting element to the light receiving element, a jet control section for controlling a jetting of the droplets group composed of the plural and continuous droplets which are jetted from the nozzle, and a jetting condition detecting section for detecting the jetting condition of the droplets from the nozzle, based on the output signal which is obtained by detecting the droplets group controlled by the jet control section by the droplet detecting section, wherein the jet control section can change the number of the droplets which compose the droplets group.

Structure 19 can adjust the sensitivity of the light receiving element of the ink-jet recording apparatus, when the droplets group passes through the detecting limit of the droplet detecting section, and can also keep up easily with a further down sizing of the droplet that is expected in future.

Structure 20 is the ink-jet recording apparatus described in Structure 16, wherein the above-mentioned jet controlling section changes the number of the droplets which compose a droplets group, in accordance with the level of the output signal that is detected by the droplet detecting device.

Structure 20 can establish the more appropriate number of the droplets.

Structure 21 is the ink-jet recording apparatus described in Structure 16, wherein the jet controlling means changes the number of the droplets which compose a droplets group, in accordance with the type of the microscopic droplets.

Structure 21 can obtain the stably detected output independently of the type of the microscopic droplet so that the invention can always conduct the correct detecting operation.

Structure 22 is the ink-jet recording apparatus described in Structure 21 having therein a discriminating section for discriminating the type of the microscopic droplet jetted from the nozzle, wherein the above-mentioned jet control section changes the number of the droplets which compose a droplets group, in accordance with the type of the microscopic droplet that is discriminated by the discriminating section.

Structure 22 can automatically control the change of the number of the droplets, in accordance with the type of the microscopic droplet.

Structure 23 is the ink-jet recording apparatus described in Structure 21 having therein, a table in which the relationship between the type of the microscopic droplet and the number of the droplets composing the droplets group according to the type is memorized in advance, wherein the above-mentioned jet controlling section changes the number of the droplets which compose the droplets group, in accordance with the table.

Structure 23 can quickly determine the proper number of the droplets, in accordance with the type of the microscopic droplets.

Structure 24 is the ink-jet recording apparatus described in Structure 21, wherein the type of the above-mentioned microscopic droplets is either one of a color, density, viscosity, temperature characteristics, and composition of the microscopic droplet.

Structure 24 can control the proper number of the droplets from the various view points of the microscopic droplet to change the number so that the more correct detecting operation can be conducted.

BRIEF DESCRIPTION OF THE DRAWINGS

FIGS. 2(*a*), (*b*) and (*c*) are drawings showing the construction of the nozzle of the recording head.

FIG. 13 is an example of a table that stipulates the relationship between the type of ink and the number of the droplets.

DETAILED DESCRIPTION OF THE PREFERRED EMBODIMENT

Figure 1:
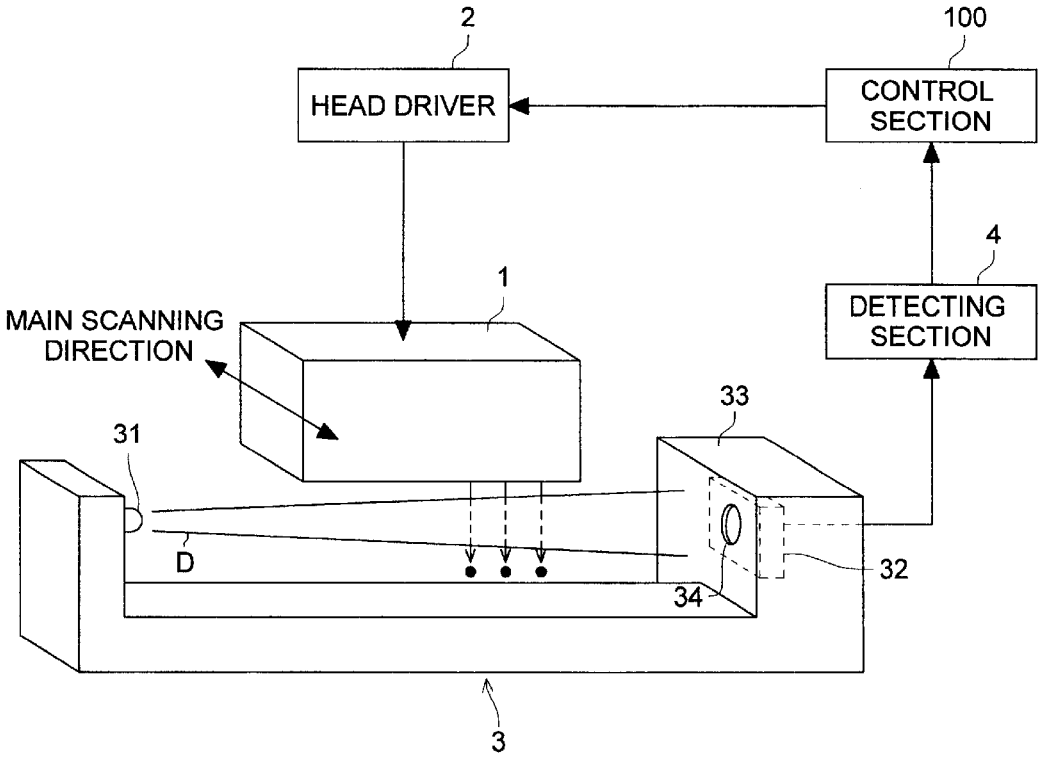
FIG. 1 is a perspective view showing the schematic construction of the microscopic droplet detecting device.

Preferred embodiments of the present invention will be described in detail below, referring to the drawings.

FIG. 1 is a perspective view showing the schematic construction of the microscopic droplet detecting device relating to the present invention. Here, there is explained the one that detects the microscopic droplets of ink that is jetted from the nozzle of the recording head, used for the ink-jet recording apparatus.

In the drawing, numeral 1 is a recording head, and under the recording head, as shown in FIG. 2(*a*), there are arranged a large number of nozzles 11, 11, - - - , in a line in the direction perpendicular to the scanning direction of recording head 1, and ink is controlled so that the ink is jetted in a shape of microscopic droplets from each of nozzles 11, 11, - - - , in the predetermined timing, by head driver 2 that is controlled by control section 100 provided in the ink-jet recording apparatus, in the downward direction in FIG. 1, so that the required image is formed and recorded on the unillustrated recording medium. The jet-controlling means is composed of the control section 100 and the head driver 2 driven by the same.

The recording head 1 is not limited to the one composed of a single head, but can be the one that is composed of a plurality of the heads 1*a*, 1*b*, 1*c*, 1*d*, - - - , for each color, as shown in FIG. 2(*b*), or in the case of single recording head 1 or a plurality of heads, the head can be the one that is formed of a plurality of the nozzle lines 11*a*, 11*b*, on each head 1*a*, 1*b*, 1*c*, 1*d*, - - - , as shown in FIG. 2(*c*).

Droplet detecting device 3 is arranged at the position where the recording head 1 does not conduct the recording of the image on the recording medium, such as a home-position of the recording head 1, and light emitting element 31 composed of an LED that emits detecting light D and light receiving element 32 composed of a photo sensor that receives-detecting light D emitted from the light emitting element 31 are provided to face each other across the distance where the recording head 1 can be placed, and the droplet detecting device 3 is arranged so that the optical axis of the detecting light D is perpendicular to the main scanning direction of the recording head 1, and further, is in parallel with the arrangement direction of the nozzles 11, 11, - - - of the recording head 1. Due to this, when the optical axis of the detecting light D that is emitted from the light emitting element 31 to the light receiving element 32 crosses the traveling direction of the droplets jetted from each nozzle 11, 11, - - - , when the recording head 1 comes into the position between the light emitting element 31 and the light receiving element 32.

The light receiving element 32 is housed in shield case 33, and detecting hole 34 is opened at the position on the shield case 33 where the detecting light D emitted from the light emitting element 31 to the light receiving element 32 is radiated. Due to this, a light receiving surface of the light receiving element 32 is shielded from light by the shield case 33, except the section where the detecting hole 34 is opened, so that the light receiving element 32 can catch only the change of the light amount of the detecting light D entered through the detecting hale 34. Accordingly, in the droplet detecting device 3, when the droplets jetted from the nozzles 11, 11, - - - of the recording head 1 pass through the detecting light D, and pass through the detecting limit where the light receiving element 32 can detect the droplets, the droplets are detected in the light receiving element 32 as the change of the light amount.

Incidentally, in the present embodiment, the distance between the nozzle 11 of the recording head 1 and the optical axis of the detecting light D is set to 5 mm, and an initial speed of the droplet jetted from the nozzle 11 is set to 6 m/sec. Further, due to this, the speed of the droplet passing through the optical axis of the detecting light D is 5 m/sec.

Figure 3:
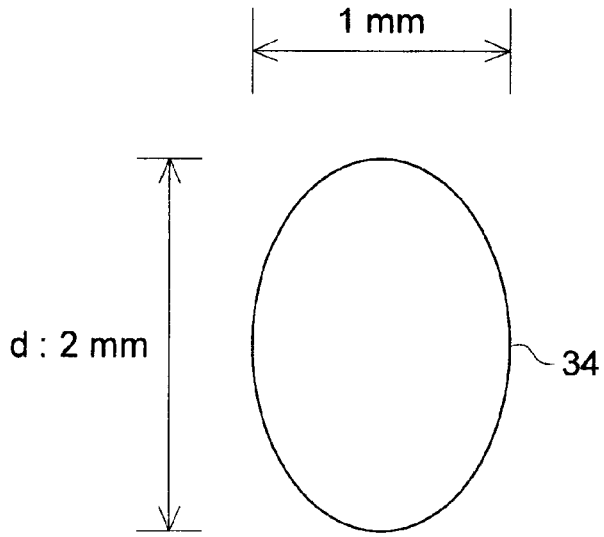
FIGS. 3(*a*) and (*b*) are drawings showing the construction of the detecting hole.
Figure 3:
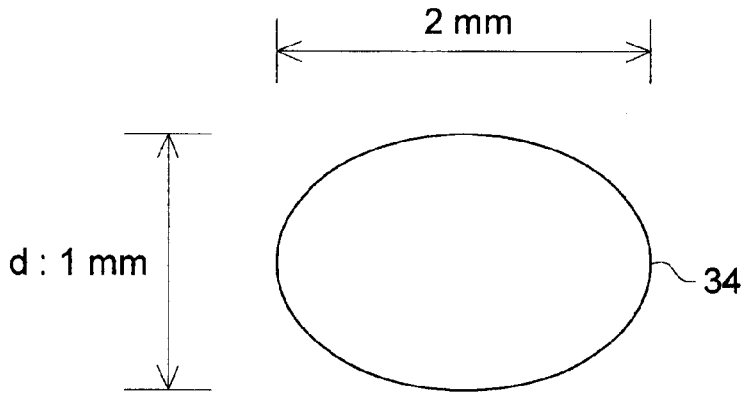

The detecting hole 34 is shaped to be an ellipse, with a major axis of 2 mm, and minor axis of 1 mm, for example. As shown in FIG. 3(*a*), if the detecting hole 34 is provided to be lengthwise along the jetting direction of ink from the recording head 1, the shaded distance of the light receiving element 32 by the droplets becomes greater, and due to this, more pieces of the droplets can be detected at the same time. Further, since the detecting hole 34 is elliptic, the total amount of light incident to the light receiving element 32 does not increase, causing the improvement of S/N ratio.

Still further, as shown in FIG. 3(*b*), when the sufficient signal amount with better S/N ratio can be obtained by the light receiving element 32, it is also possible to arrange the light receiving hole 34 so that the detecting hole 34 is provided to be oblong along the jetting direction of ink from the recording head 1. In this case, it is possible to decrease the number of the droplets jetted from the nozzle, and further possible to increase the detecting margin in the main scanning direction (the direction along the major axis of the detecting hole 34), for example, there is an effect that a control mechanism having higher accuracy for a stopping control is not needed for the positioning of the recording head 1 with respect to the droplet detecting means 3, as compared with the case that the detecting hole 34 is provided to be lengthwise, as shown in FIG. 3(*a*).

As mentioned above, concerning the lengthwise ellipse and the oblong ellipse, whichever ellipse the detecting hole 34 may be formed in, the detecting hole 34 is formed in the distance d of the traveling direction of the droplet, having size in which a plurality of droplets jetted from the nozzle 11 can exist.

The signal for the change of the amount of light detected by the light receiving element 32 is outputted to the detecting section 4, and the presence/absence of the jetting of the droplet from each of the nozzle 11, 11, - - - of the recording head 1 is detected. It is decided in the present invention that the change of the signal of the amount of light detected by the light receiving element 32 is not caused by a single piece of the microscopic droplet jetted from the nozzle 11, but is caused by the droplets group that is composed of the plural and continuous droplets. That is, in the detection of the jetting condition from the nozzle, the head driver 2 is controlled by the control section 100 so that the recording head 1 in the operation of droplet detection is controlled to jet the droplets group composed of the plural and continuous droplets of ink. Due to this, the droplet is detected by the light receiving element 32 as a large unit represented by the droplets group, and thereby, though the nozzle 11 of the recording head 1 jets the microscopic droplets, it is possible to detect the droplets by the light receiving element 32, without reducing the light from the light emitting element by an optical system, or without applying the structure for miniaturizing the size of the detecting hole in accordance with the size of the microscopic droplet.

Figure 4:
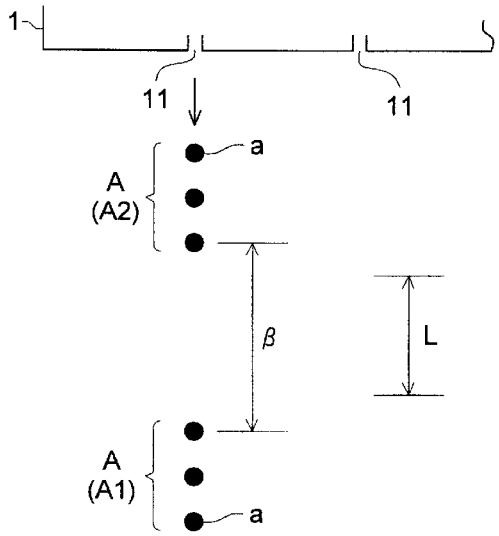
FIGS. 4(*a*) and (*b*) are drawings for illustrating the droplets and the droplets group jetted from the nozzle.
Figure 4:
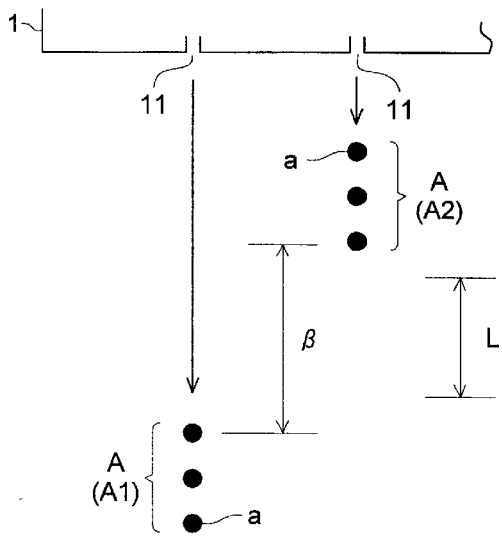

For the further detailed illustration, as shown in FIGS. 4(*a*) and 4(*b*), the control section 100 performs driving control of the head driver 2, and makes each of the nozzle 11, 11, - - - of the recording head 1 to jet a plurality of droplets a, a, - - - continuously to form a set of droplets group A, and further makes the recording head 1 to jet the droplets group A. In case of jetting the droplets group A, when a set of the droplets group A is jetted from a single nozzle successively (FIG. 4(*a*)), or when the continuous jetting of a set of the droplets group A from a single nozzle is repeated by a plurality of nozzles respectively, (FIG. 4(*b*)), there is provided the suspension period in which droplet a is not jetted, between a set of the droplets group A1 (or A2) and a following set of the droplets group, detected by the droplets detecting means 3 (for example, between the last droplet of the droplets group A1 and the first droplet of the droplets group A2). Due to the existence of the suspension period, each droplets group A in front or rear of the suspension period can be regarded as an independent single group.

Here, when the suspension period is represented by β, a distance along the traveling direction of the droplets within the detecting limit of the droplet detecting means 3 is represented by L (m), and a speed of droplet a for passing through the detecting limit of the droplet detecting means 3 is represented by V (m/sec), the suspension period β satisfies the following condition.

$$\beta \geqq L/V$$

By setting the suspension period β to satisfy the above-mentioned condition, the distance between a set of the droplets group A1 having passed through the detecting limit of the droplet detecting means 3 first and a set of the droplets group A2 passing through next is larger than the distance L along the traveling direction of the droplets A in the detecting limit of the droplets detecting means 3. Accordingly, when the droplets group A is jetted from the same nozzle, or even when the droplets group A is jetted continuously from the different nozzle, a single droplets group A passes through the detecting limit of the droplets detecting means 3, and the output signal from the light receiving element 32 is obtained as the signal of the droplets group A which is grouped in a single unit. Due to this, in the output signal from the light receiving element 32, the detecting condition that a set of the droplets group A passes through is discriminated clearly from the non-detecting condition that is in the suspension period, then the noise component can be easily eliminated by a high pass filter, and only the detecting signal with better S/N ratio is easily taken out.

Incidentally, the detecting limit of the droplets detecting means 3 means the area of the light flux of the detecting light D, emitted from the light emitting element 31, that is detected by the light receiving element 32.

Further, it is preferable that the above-mentioned suspension period β satisfies the condition 5 m sec≧β. When β satisfies this condition, the influence of the disturbance light existing in the vicinity of 200 Hz or of the noise from the power supply is decreased so that the detection having the better S/N ratio can be conducted.

Figure 5:
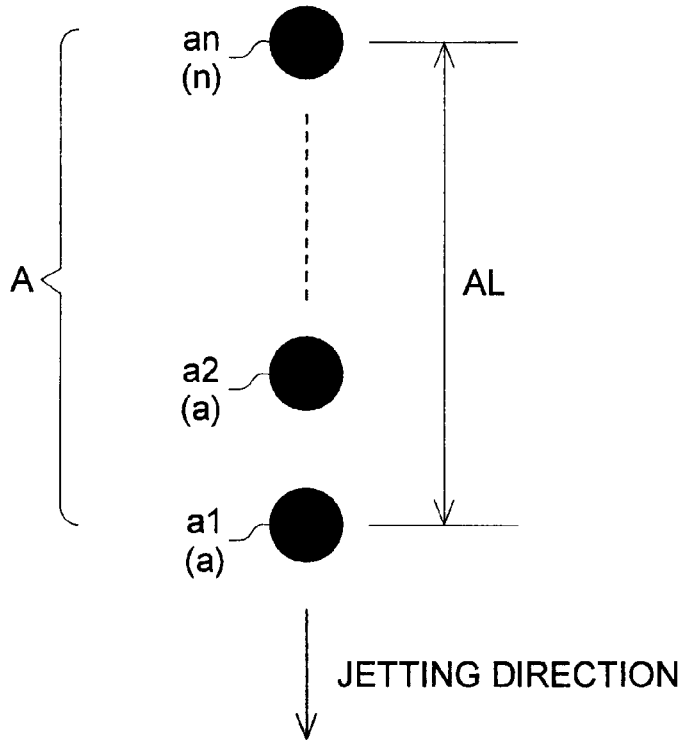
FIG. 5 is a drawing illustrating the droplets group.

Still further in the present invention, as shown in FIG. 5, when a time period, obtained by dividing distance AL, between the center of first droplet a1 and last droplet an which compose a set of droplets group A jetted when the head driver 2 is controlled to be driven by the control section 100, with the average speed of the droplet a, is represented by α (sec), the following condition is satisfied, in the relationship between the distance L along the traveling direction of the droplets group A in the detecting limit of the droplets detecting means 3 and the speed V of the droplet a to pass through the detecting limit of the droplets detecting means 3.

$$5 \text{ m sec} \geqq \alpha n \geqq 0.5L/V$$

When αn is in this limit, the influence caused by the noise is less and it is possible to obtain the sufficient signal output in the light receiving element 32. That is, when αn is not greater than the upper limit, the influence of the disturbance light existing in the vicinity of 200 Hz and of the noise from the power supply is decreased, and when αn is not smaller than the lower limit, it is possible to obtain the sufficient signal output in the light receiving element 32.

The control section 100 can control the device so that a set of the droplets group A is jetted continuously from each nozzle 11 after the interval of the suspension period β (FIG. 4(*a*)), or can control the device with the suspension period β between the time of individual jetting of a set of the droplets group from each nozzle 11 and the time of the jetting from the next nozzle 11 (FIG. 4(*b*)). In the former case, it is possible to improve the certainty of the detection of the jetting condition of the droplet a from nozzle 11 that jets the droplets group A. Further, the latter case can be applied preferably to the case of detecting the flying speed of the droplet a that is jetted from the nozzle 11 by the droplets detecting means 3, although it can be applied to the case of detecting the presence/absence of the jetting of the droplet a from the nozzle 11. Since the distance between the recording head 1 and the optical axis of the detecting light D of the droplets detecting means 3 is constant, the flying speed of the ink can be obtained, based on an applying time of the jetting signal and a period of time required for the droplets detecting means 3 to have detected a set of the droplets group A, namely, a period of time required for the droplets group A to have passed through the detecting light D, for example.

Further, when the droplets group A is jetted from each nozzle 11 individually, the detecting operation of the jetting condition about all nozzles of a single recording head can be completed quickly, that is a merit. Especially in recent years, by the addition of polymer such as latex to the ink, it becomes possible to form an image having higher image quality without bleeding or color mixture on the medium such as PET base that cannot absorb the ink. Though the image formation superior to the photography is available, the ink easily adheres to an opening of the nozzle in the non-jetting period, and there is a trouble that an abnormal jetting happens when the jetting restarts after the interval of a very short period of the stop of the ink jetting, which is a fear of occurrence of troubles. However, since the time period between the start of the detection of the jetting condition of the first nozzle and that of the last nozzle for one recording head is short, the nozzle that is on the latter half of the detecting of the jetting condition is not placed on the non-jetting condition for a long time, accordingly, it is possible to jet the ink from all nozzles of the recording head under the normal condition.

Incidentally, in the latter condition, concerning the distance between adjoining droplets a in a set of the droplets group A, there is no need to be the same between the droplets groups A jetted from the different nozzles.

Further, in the recording head 1, the device can be controlled so that the case that a set of the droplets group A is jetted from each nozzle 11 continuously with suspension period β, and the case that only a set of the droplets group A is jetted, are used together. For example, concerning the nozzle that is for the first half way of the detecting of the jetting condition for the recording head, a set of the droplets groups A is jetted from each nozzle individually and the suspension period β is provided in the period up to the jetting from the next nozzle to detect early. Concerning the nozzle that is for the second half of the detecting of the jetting condition, a set of the droplets groups A is jetted continuously from each nozzle with the interval of the suspension period β. Thus, the certainty of the detection can be realized.

Figure 6:
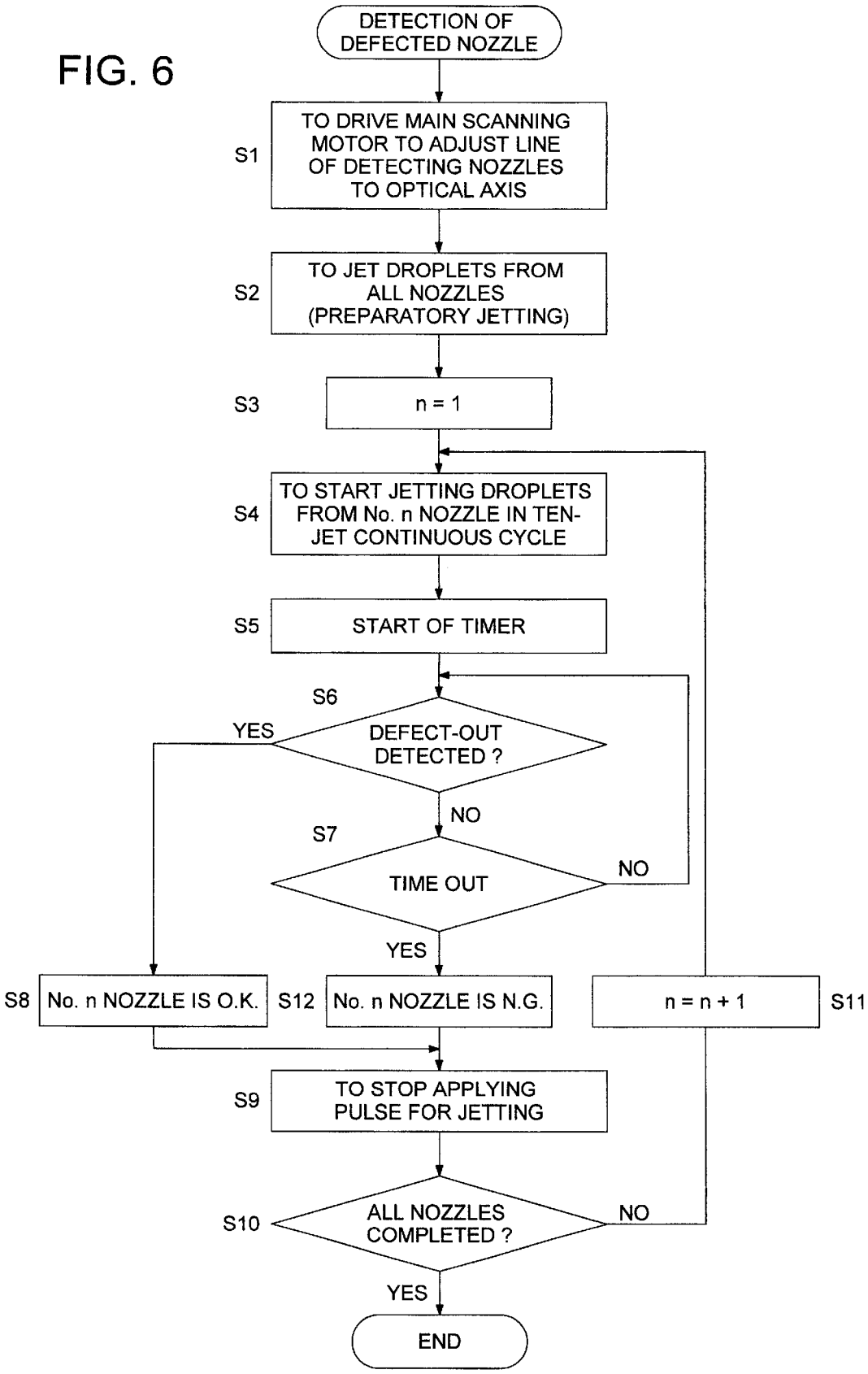
FIG. 6 is a flow chart showing the detecting operation of the droplet.

Next, the operation for detecting a non-jetting nozzle of the recording head 1 in the ink-jet recording apparatus will be explained by the flow chart shown in FIG. 6, and further the construction relating to the present invention will be explained. Incidentally, there is shown the case that a set of the droplets groups A is jetted continuously from each nozzle 11 of the recording head 1 with the interval of the suspension period β, that is shown in FIG. 2(*a*). In this case, it is possible to omit the preparatory jetting in the step S2 that is shown in the following.

Figure 7:
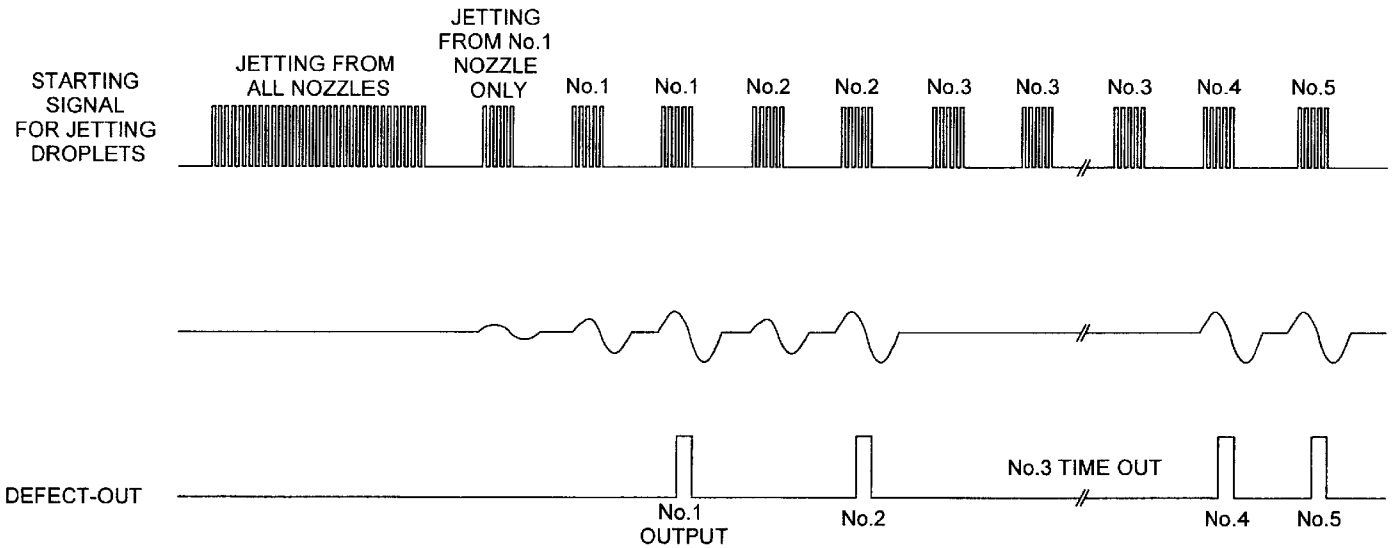
FIGS. 7(*a*), (*b*) and (*c*) are timing charts showing the detecting operation of the droplet.

Firstly, the recording head 1 is arranged on the droplets detecting means 3 so that the nozzle line may be in parallel with the optical axis of the detecting light D of the droplets detecting means 3 by the drive of an unillustrated scanning motor, that is, so that the droplets jetted from each nozzle 11, 11, - - - pass through the detecting light D (S1). Next, the control section 100 drives the head driver 2, and performs the preparatory jetting so that the stable and good jetting is performed, before the detecting operation (S2). In this preparatory jetting, all nozzles of the recording head 1 are controlled so that they jet the plural droplets. It is preferable to jet the droplets (for example one hundred droplets) by which the stable jetting can be obtained for the ordinarily normal nozzle. A jet starting signal driven by the head driver 2 is shown in FIG. 7(*a*).

After the preparatory jetting, the control section 100 controls the head driver 2 firstly so that ink-jetting is performed from first nozzle No.1 among the nozzles 11, 11, - - - , of the recording head 1, (S3, S4). Here, a set of the droplets group is composed of ten pieces of the droplets to be jetted continuously, where, $\alpha n$=300 $\mu$sec, $\beta$=533 $\mu$sec, V=6 m/sec, and L=1 mm.

Each of the droplets group jetted from the first nozzle No. 1 passes through the detecting light D emitted from the light emitting element 31 of the droplets detecting means 3. A portion of the detecting light D is shielded by the passage of each of the droplets in the light detecting element 32. In this case, since there is provided the predetermined suspension period between the front droplets group and the rear droplets group in the jetted droplets groups, the received light amount signal is reduced temporarily by the passage of each of the droplets group.

Figure 8:
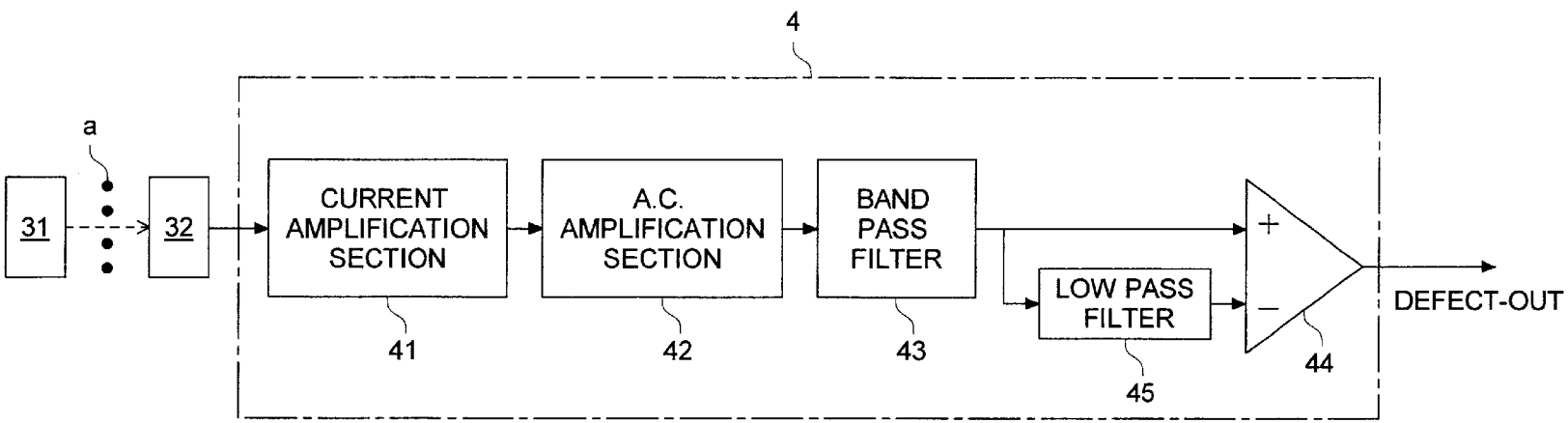
FIG. 8 is a block chart showing the electrical construction of the detecting section.

As shown in FIG. 8, the detecting section 4 amplifies the light amount signal received by the light receiving element 32 by current amplification section 41, and next, amplifies only the changed value in A.C. amplification section 42, and further, removes the unwanted noise components in band pass filter 43, and obtains the signal to compare with the standard signal. The wave form of this signal is shown in FIG. 7(*b*).

Next, in comparator 44, this signal is compared with the standard signal which is produced by passing through low pass filter 45. The comparator 44 detects a changed signal that is greater than the standard signal. That is, when the droplets groups are jetted continuously from the first nozzle No. 1, and further, either one of the droplets group passes through the detecting light D, the existence of the portion of the changed signal that is greater than the standard signal is detected in the comparator 44, and a pulse signal showing a defect-out of the nozzle (the detection of non-jetting) is outputted. This pulse signal is shown in FIG. 7(*c*). In FIGS. 7(*a*) to 7(*c*), the case that the passage of the droplets group jetted as the third jetting trial by the first nozzle No. 1 is detected by the detecting section 4.

The control section 100 starts the jetting of the droplets group, and at the same time, starts the timer (S5), and detects the presence/absence of the output of the pulse signal coming from the detecting section 4 (S6). In the control section 100, the passage of the predetermined time-out interval (here, established to 20 m sec) is detected by the start of the timer (S7). When the presence of the pulse signal is detected before the passage of the time-out interval (YES in S6), the controller 100 judges that the jetting of the ink is normally conducted from the first nozzle No. 1 (S8), and stops applying the pulse for the jetting to the first nozzle No. 1 (S9).

After that, the above-mentioned detecting operations which are after S3 are repeated for second nozzle No. 2, third nozzle No. 3, - - - , one by one, until all nozzles are checked (S10, and S11).

Here, as shown in FIGS. 7(*a*) to 7(*c*), for example, when the droplet is not jetted practically from the nozzle, though the jetting pulses are given to the third nozzle No. 3 from the head driver 2 to jet continuously the droplets groups, the light receiving element 32 does not detects completely the passage of the droplets group at all, and thereby, after detecting the passage of the predetermined time-out interval (YES in S7), the control section 100 judges that the third nozzle No. 3 is a defect-out nozzle that does not jet the ink (S12), and stops applying the jetting pulse to the third nozzle No. 3 (S9).

At this moment, the control section 100 warns that nozzle No. 3 is defective by outputting signals to an unillustrated warning means. Incidentally, the jetting condition detecting means is composed of the control section 100 and the detecting section 4.

Incidentally, in this explanation, the droplets group A that is composed of a plurality of the droplets a are jetted continuously from each of the nozzles 11, 11, - - - of the recording head 1, with the interval of the suspension period. For example, when the number of the nozzles of the recording head 1 is 128 pieces, and the distance ($\alpha$) between droplets a of the ink is 30 $\mu$m, and when one group of the droplets is composed of 10 droplets, and the jetting of 300 $\mu$sec and the non-jetting 533 $\mu$sec make a cycle of 833 $\mu$sec, accordingly, the shortest time is around 128×833 $\mu$sec, that is, the detecting time for all nozzles is less than 0.2 sec, and due to this, the amount of the ink consumed in the detecting time is extremely little, causing no problem, as compared with the ink amount used for the image recording.

The above-mentioned matter is an example of the case wherein a set of the droplets group A is jetted continuously from each of the nozzles 11, 11 - - - of the recording head 1, with the interval of the suspension period. When the droplets group A is jetted individually from each of the nozzles 11 of the recording head 1, in the step of S4 in FIG. 6, the control section 100 forms firstly one droplets group, by jetting, for example, ten pieces of the droplets continuously from the first nozzle No. 1 of the nozzles 11, 11, - - - of the recording head 1, and controls the head driver 2 to jet the droplets groups. Further, in this case, since the droplets group is jetted individually, the step of S9 in FIG. 6 is not necessary.

Further, the above-mentioned matter is explained under the condition that the number of the droplets a which compose the droplets group A that are jetted from each of the nozzles 11 is fixed, however, in the present embodiment, the number of the droplets a which compose a set of the droplets group A is adjustable. By making the number of the droplets to be adjustable, it is possible to adjust the sensitivity of the light receiving element 32, when the droplets group A passes through the detecting limit of the droplets detecting means 3. Especially in the recent years, since the improvement of the quality of the image to be recorded is highly requested, the droplet a jetted from the nozzle 11 becomes smaller, and there is a tendency that the acquisition of the sufficient S/N ratio on the recording element 32 side is more and more difficult, however, it is possible to cope with the further down-sizing of the droplet which will be expected in future, by employing the manner that the number of the droplets a which compose a set of the droplets group A is changed (increased) so that the shadow of the droplets group A which is caught by the light receiving element 32 is enlarged. The adjustment of the number of the droplets is conducted by changing the driving frequency with which the head driver 2 is driven by the control section 100.

The establishment of the number of the droplets a which compose the droplets group A can be conducted by an input operation with an appropriate input means operated by an operator, however, it is preferable that the control is performed for changing the number of the droplets based on the level of the output signal when the droplets group A is detected by the droplets detecting means 3, because the more reasonable number of the droplets can be established, which is explained in the following.

Figure 9:
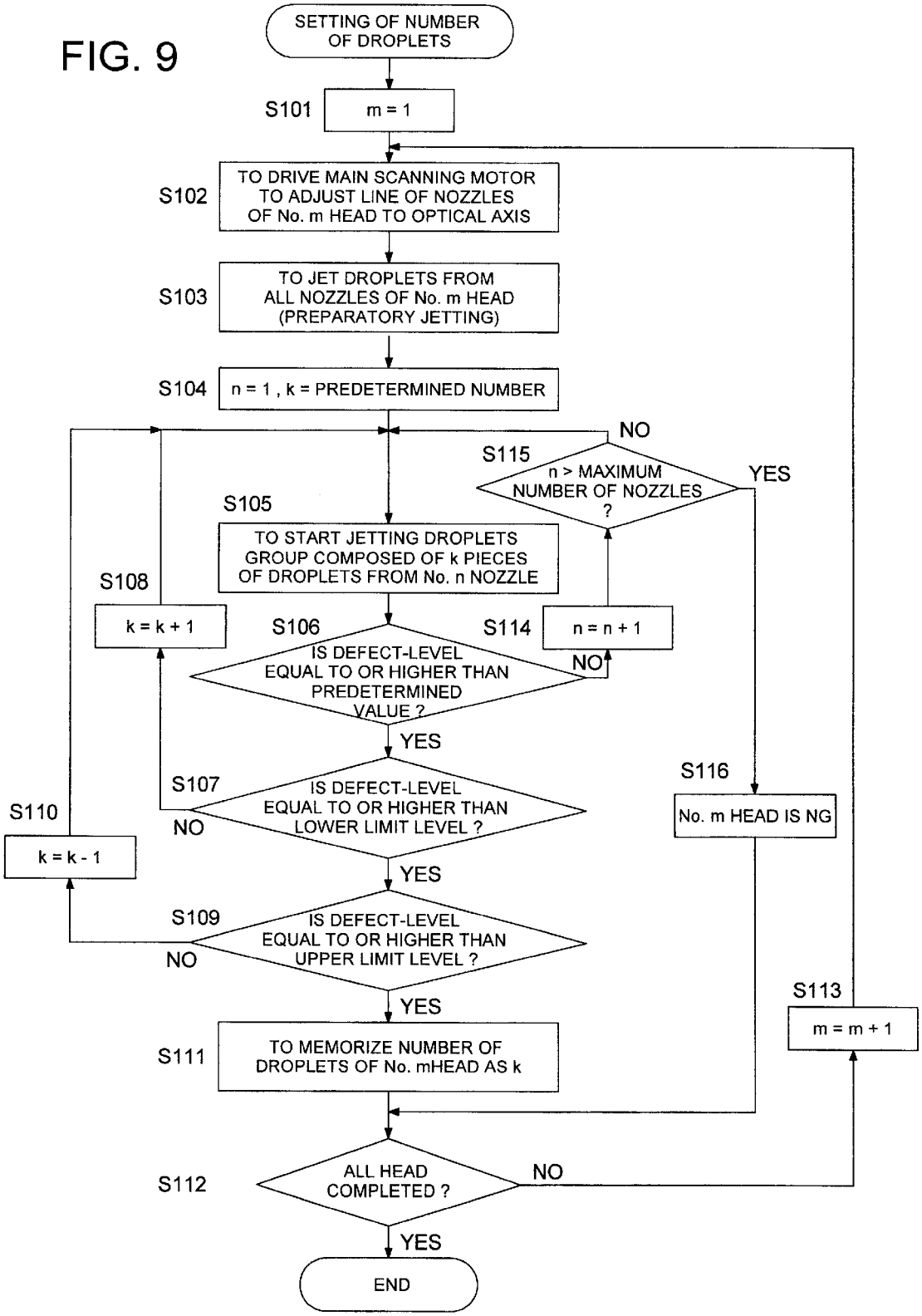
FIG. 9 is a flow chart showing the establishing operation of the number of the droplets.
Figure 10:
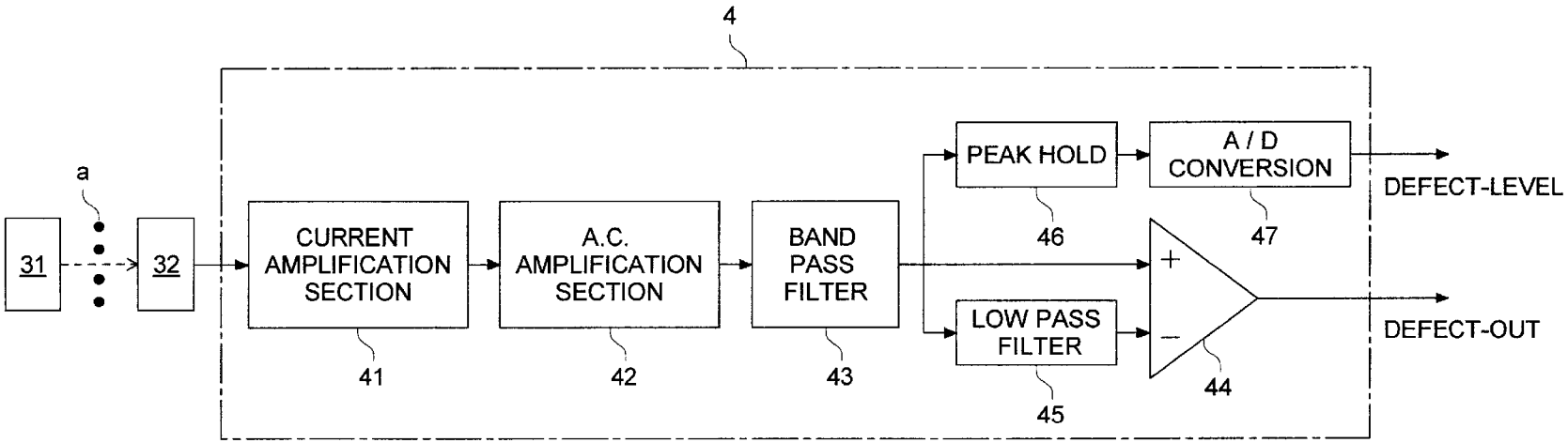
FIG. 10 is a block chart showing the other electrical construction of the detecting section.

The construction of the control section 100 and the detecting section 4 which is preferable for controlling the change of the numbers of the droplets is illustrated by the flow chart shown in FIG. 9 and the block diagram showing the electric construction of the detecting section 4 shown in FIG. 10. Here, there is shown an example wherein when the recording head 1 is composed of the plurality of the heads 1*a* to 1*d* for each color shown in FIG. 2(*b*), a set of the droplets group is jetted individually from each nozzle 11 of each of the heads 1*a* to 1*d*.

Firstly, the control section 100 drives a main scanning motor (not shown) to perform the detecting operation of the first head (m=1) of the recording head, so that the nozzle line of the first head is adjusted to the optical axis of the detecting light D of the droplets detecting means 3 (S101, S102), next, makes all nozzles of the first head to jet the droplets so that the preparatory jetting for the predetermined jetting number is performed (S103).

After that, the nozzle for jetting the droplets is set to the nozzle No. 1 of the first head (n=1), the predetermined number (here, k=8) is set to the number (k) of the droplets to be jetted (S104), then the nozzle No. 1 jets the droplets group that is composed of eight pieces of the droplets (S105).

When the droplets group, which is composed of eight pieces of the droplets jetted from the nozzle No. 1, passes through the detecting light D, the shadow of the droplets group is caught by the light receiving element 32, the detected signal passes through current amplification section 41, A.C. amplification section 42, and band pass filter 43, then a peak level of the detected signal is detected by peak hold section 46, and is A/D-converted by A/D converting section 47, so that the control section 100 outputs it as defect-level. The control section 100 compares the output signal represented by the defect-out with the predetermined value that is memorized in advance, and judges whether the sufficient output signal is obtained or not (S106). This predetermined value has been established to be the output signal of a smallest level that is possible to be separated from the noise components.

Here, in the case that the signal output greater than the predetermined value has been obtained, the control section 100 compares the output signal of the defect-level with the lower limit level of the droplets detecting signal memorized in advance, and judges whether the signal output, which is greater than this lower limit level, is obtained or not (S107). As the result of the comparison, when the output signal of the defect-level is lower than the lower limit level, the control section 100 sets the number of the droplets to k+1 (S108), then jets the droplets group that is composed of nine pieces of the droplets added one droplet, from the same nozzle, and repeats the steps S105 to S107, until the output signal of the defect-level becomes greater than the lower level.

When the output signal of the defect-level is greater than the lower limit level in step S107, the control section 100 compares the output signal of the defect-level with the upper limit level of the droplets detecting signal memorized in advance, and judges whether the output signal of the defect-level is lower than the upper limit level or not (S109). As the result of the judgment, when the output signal of the defect-level is greater than the upper limit level, the control section 100 sets the number of the droplets to k−1 (S110), then jets the droplets group that is composed of seven pieces of the droplets subtracted one droplet, from the same nozzle, and repeats the steps S105 to S109 until the output signal of the defect-level becomes lower than the upper level.

When the output signal of the defect-level is judged to be lower than the upper limit level in step S109, the control section 100 memorizes the number k of the droplets as the appropriate number of the droplets of the droplets group jetted from the first head (S111).

After that, the control section 100 repeats the steps from the above mentioned step S102, for the second head, third head, - - - , of the recording head (S112, and S113).

Incidentally, when the output signal of the defect-level is lower than the predetermined value memorized in advance in step S106, the number n of the nozzle for jetting the droplets is set to n+1 (S114), and when the number is not greater than the number of all nozzles of the head (S115), the steps from the above-mentioned step S105 are repeated. When the value of n+1 is greater than the number of all nozzles, that is, the output signal of defect-level for all nozzles is lower than the predetermined value, the head is judged to be defected for jetting the droplets (S116). At this time, the control section 100 outputs the signal which warns the warning section to display the malfunction or the replacement of the m-th head.

Since the optimum number of the droplets for each head can be set in this construction, the number of the droplets that compose the droplets group can be set exactly, even though there is dispersion for each head, and thereby, the reliability of the detection of jetting condition can be improved.

Figure 11:
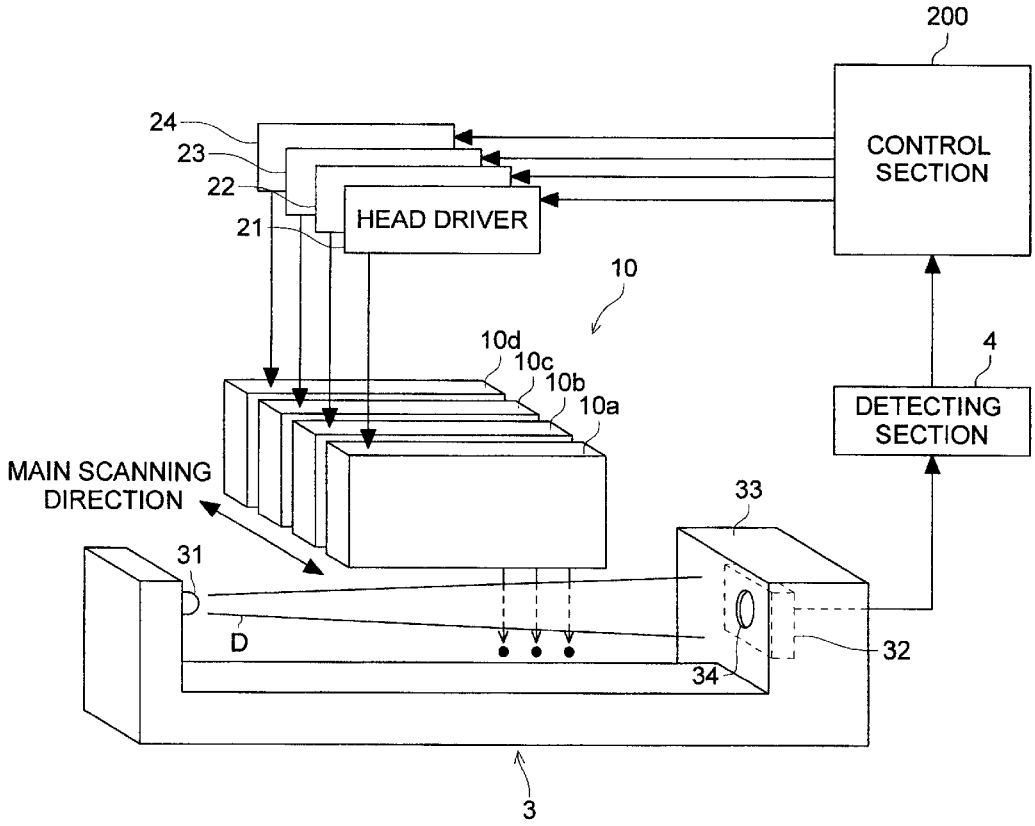
FIG. 11 is a perspective view showing the schematic construction of the microscopic droplet detecting device relating to the other embodiments.

FIG. 11 is a perspective view showing the schematic construction of the microscopic droplets detecting device relating to the other embodiment of the present invention. In this embodiment, there is shown the schematic construction of the main section of the ink-jet recording apparatus employing the recording head 10 having four heads 10*a*, 10*b*, 10*c*, and 10*d*. The symbols same as those shown in FIG. 1 show the same constructions.

The ink composed of different colors (for example, Y, M, C and K) are supplied individually to each of the heads 10*a*, 10*b*, 10*c*, and 10*d* which compose the recording head 10 from different ink-tanks (not illustrated), and the ink of the different colors in the forms of the microscopic droplets are controlled so that they are jetted downward in FIG. 11 from the nozzles of each of the heads 10*a*, 10*b*, 10*c*, and 10*d* by the head drivers 21, 22, 23 and 24 which are driven by controlling section 200, and form and record the desired color image on the recording medium which is not illustrated. Incidentally, the nozzle construction of each of the heads 10*a*, 10*b*, 10*c* and 10*d* is the same as the construction that is illustrated in FIG. 2. Since the construction for detecting the jetting condition of the droplets jetted from each nozzle is the same as the construction that is illustrated above, the explanation thereof is omitted here.

In this embodiment, the control section 200 for controlling the ink jetting from the recording head 10 is designed to be able to change the number of the droplets which compose a set of the droplets group A, depending on the type of ink which are jetted from each of heads 10*a*, 10*b*, 10*c* and 10*d*. This is because, though all numbers of the droplets which compose the droplets group are the same, the output detected by the droplets detecting means 3 for the yellow ink is smaller than that of the black ink, by the reason that the transmittance for the detecting light D varies depending on the ink type, and thereby, there is fear that the correct detection cannot be conducted according to ink type. In the present embodiment, it is possible to obtain the stable detecting output, independently of the ink types, by changing the number of the droplets which compose the droplets group, according to the ink type, and thereby to conduct the correct detecting operation, constantly.

It is possible to conduct the discrimination of the ink type by an inputting operation by an operator on a proper manual means, however, it is preferable to provide the discriminating means for discriminating the ink type automatically, which will be described in detail below. That is, as shown in FIG. 12, the control section 200 is designed to be provided with ink type discriminating section 201 for discriminating the ink type (color of ink, in this case), and which can change the number of the droplets which compose a droplets group according to the ink type.

Figure 12:
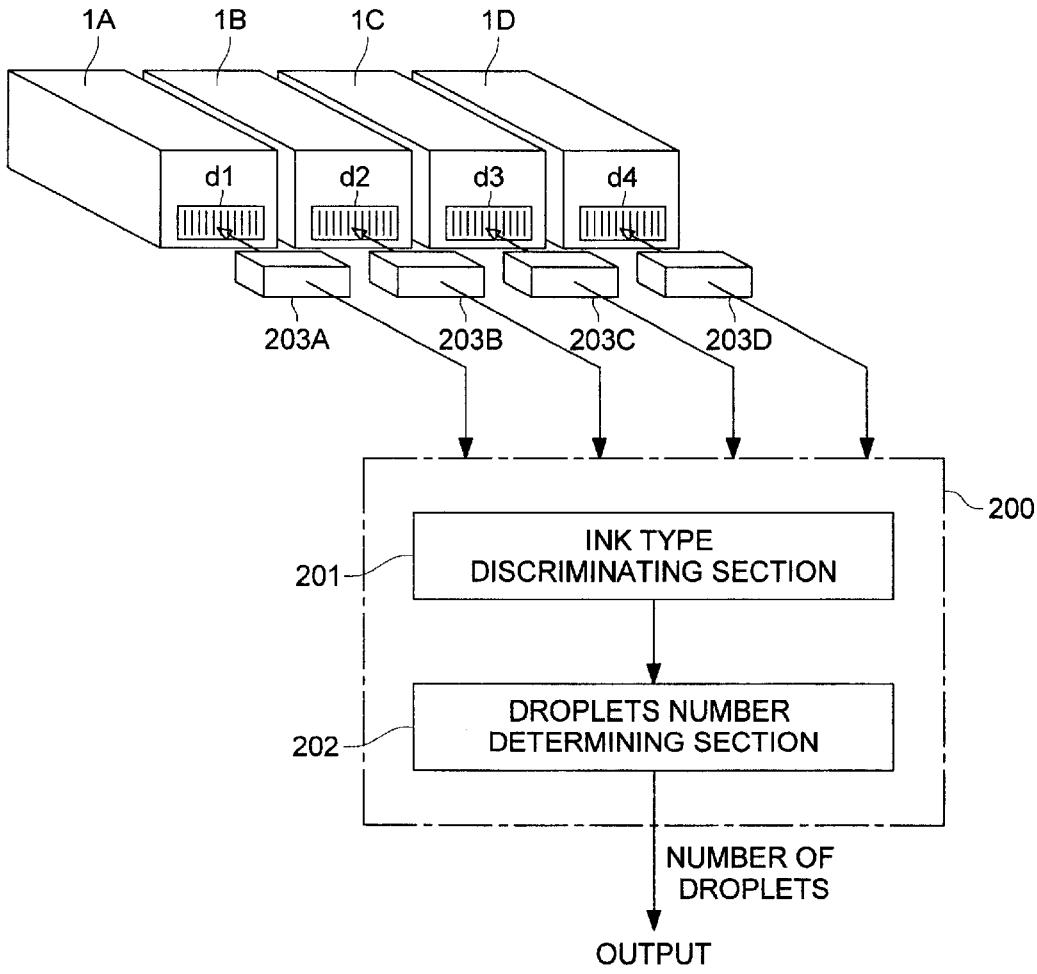
FIG. 12 is a drawing illustrating the structure for discriminating the type of ink.

The discrimination by the above-mentioned ink type discriminating section 201 can be conducted by the manner that recording sections d1, d2, d3 and d4 such as bar codes in which the data of the ink type are recorded in advance are provided on the ink cartridges 1A, 1B, 1C and 1D for respective colors each having an ink tank, and when these ink cartridges 1A, 1B, 1C and 1D are installed on the recording apparatus, reading means 203A, 203B, 203C and 203D, such as bar code readers provided on the recording apparatus main body, read the recording section automatically for the discrimination, as shown in FIG. 12, or the discrimination can be conducted by the manner that the operator operates the input device appropriately to input manually the data for ink types, and the discrimination is conducted by the inputted data.

The datum for ink type discriminated by the ink type discriminating means 201 is outputted on droplets number determining section 202 in the control section 200. According to the discriminated ink type, the droplets number determining section 202 determines the proper number of the droplets which compose a set of droplets group which is jetted from each of the heads 10*a*, 10*b*, 10*c* and 10*d* individually.

It is preferable that the droplets number determining section 202 has table 202*a* in which the relationship between the ink type and the number of the droplets according to the ink type is memorized in advance. When the ink type is the ink color, it is possible to determine quickly the preferable droplets number corresponding to the discriminated ink type by stipulating in advance each color of Y, M, C and K and the preferable droplets number corresponding to each color, in the table 202*a* shown in FIG. 13, for example.

It is possible to make ink types to be difference of density of ink, difference of viscosity of ink, difference of temperature characteristics of ink, and difference of composition of ink (pigment system or dye system), without being limited to the difference of color, and to determine the preferable number of droplets composing a group of droplets for each ink type, in the same way as in the foregoing. Further, the droplets number can be also stipulated according to the combination of more than two types, such as the combination of color of ink and density of ink as shown in FIG. 13.

Figure 14:
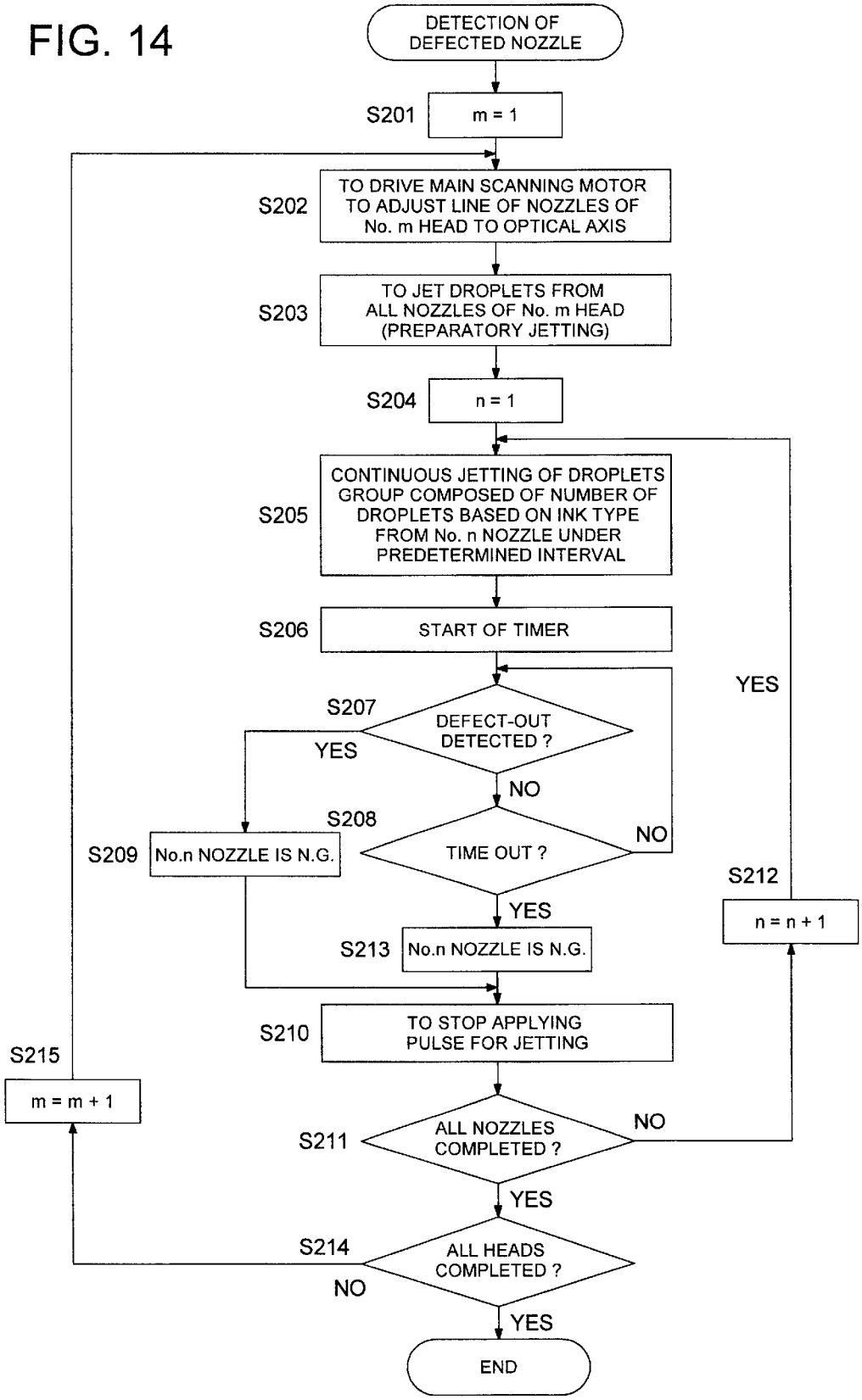
FIG. 14 is a flow chart showing the detecting operation of the droplets in the other embodiment.

Next, the operation for detecting the defected nozzle of the recording head 10 in the present embodiment will be described, referring to the flow chart shown in FIG. 14. Incidentally, there is exemplified the case that a set of the droplets group is jetted from each nozzle continuously after the interval of the above-mentioned suspension period, and the detailed description about the operation that is the same as the flow chart shown in FIG. 6 is omitted.

Firstly, by the drive of the scanning motor not shown, the nozzles line of the first head (for example, head 10*a*) representing that in the m-th head of the plurality of heads 10*a*, 10*b*, 10*c* and 10*d* which compose the recording head 10, m is set to one, or m=1, is arranged on the droplets detecting means 3 so that the nozzles line to be in parallel with the optical axis of the detecting light D of the droplets detecting means 3 each other (S201 and S202). Next, the control section 200 controls the head driver 2 for driving, and performs the preparatory jetting before the detecting operation, to perform the better and stable jetting (S203).

After the preparatory jetting, the control section 200 discriminates or discriminates in advance the ink type which is jetted from the first head 10*a* that performs the first detecting operation, and determines the appropriate number of the droplets which compose the droplets group based on the result, and further controls the head driver 21 so that the droplets group composed of the droplets of the determined number is jetted from the first nozzle No. 1 of the first head 10*a* (S204 and S205).

Next, the control section 200 starts jetting the droplets group, and at the same time, starts a timer (S206) and detects the presence/absence of the output of the pulse signal from detecting section 4 (S207). The control section 100 detects the passage of the predetermined time-out time (here, set to 20 m sec) by the start of the timer (S208), and therefore, when the control section 200 detects the presence of the pulse signal before the passage of the time-out time (YES in S207), it judges that the normal jetting from the first nozzle No. 1 is performed (S209), and stops applying the jetting pulse to the first nozzle No. 1 (S210).

After that, the above-mentioned detecting operation on and after S205 are repeated for the second nozzle No. 2, the third nozzle No. 3, - - - , until all nozzles are completed (S211 and S212), and when there is a nozzle in which the passage of the droplets group is not detected, it is judged to be the defected nozzle (S213), and the control section 200 stops applying the jetting pulse to the nozzle (S210), and warns about an the defected nozzle by outputting a signal to an unillustrated warning means.

Next, in order to perform the detection of the second head (for example, head 10*b*), the control section 200 drives the unillustrated main scanning motor so that the nozzles line of the second head 10*b* is arranged on the optical axis of the droplets detecting means 3 to be overlapped each other, and repeats the same operation mentioned above (S214 and S215). At this time, the color of ink jetted from the second head 10*b* is different from that of the above-mentioned first head 10*a*, and thereby, when the appropriate number of the droplets, based on the color of the ink, is different from that of the first head 10*a*, the number of the droplets jetted from the second head 10*b* is changed from the number of the droplets in the case of the first head 10*a*. Accordingly, there is no occasion that the detected output from the droplets detecting means 3 is different by the change of the ink type, and thereby, the stable detecting output is obtained independently of the ink type, and the correct detecting operation can be performed.

Incidentally, in the embodiment in which the number of the droplets which compose a set of the droplets group is changed, when the number of the droplets is changed, the jetting amount of the droplets per unit time is not changed, while only the number of the droplets jetted continuously is changed. Further, even when the number of the droplets is not changed, it is preferable that the jetting amount of the droplets per unit time is not changed for both of the normal printing operation and the jetting condition detecting operation, because it prevents the occurrence of the defective jetting that is departed from the optimized printing condition for the normal printing operation.

The above-mentioned description is for the case of the ink-jet recording apparatus which performs the recording by jetting the droplets on the recording medium from the nozzle installed on the recording head, and the detecting device of the microscopic droplets relating to the present invention is capable to be applied widely to the detection of the passage of the microscopic droplets jetted from the nozzle.

In the present invention, the droplets group composed of the plurality of the droplets is jetted from the nozzle, and the suspension period satisfying the prescribed condition is provided between the front droplets group and the rear droplets group both of which are measured by the droplets detecting device, and thereby, it is possible to discriminate optically the detection from the non-detection of the droplets jetted from the nozzle, and further it is possible to provide the microscopic droplets detecting device and the ink-jet recording apparatus which can realize the detection of the jetting condition of the droplets jetted from the nozzle, with high S/N ratio.

What is claimed is:

1. A microscopic droplet detecting device for detecting a passage of droplets jetted from a nozzle of an ink jetting device, comprising:

a droplet detecting section including a paired light emitting and receiving elements which are arranged such that the light emitting element emits a light flux so as to cross a traveling course of the droplets jetted from the nozzle and the light receiving element receives a detecting light flux among the emitted light flux, wherein a detecting area of the detecting light flux corresponds to a light receiving area of the light receiving element;

a jet control section to control the ink jetting device to jet droplets serially along the traveling course in such a way that serial droplets simultaneously exist in a form of group in the detecting area of the detecting light flux so that the droplet detecting section detects the group of serial droplets and outputs an output signal representing the group of serial droplets; and a jetting condition detecting section to detect a jetting condition of the nozzle based on the output signal;

wherein the jet control section controls the ink jetting device to jet plural groups of serial droplets so as to satisfy the following formula:

$$\beta \geqq L/V$$

where $\beta$ is a suspension time period (m sec) between a preceding group of serial droplets and a following group of serial droplets, L is a distance (m) of the detecting area of the detecting light flux along the traveling course of droplets, and V is a speed (m/sec) of a droplet when the droplet passes over the detecting area of the detecting light flux.

2. The microscopic droplet detecting device of claim 1, wherein $\beta$ satisfies the following formula:

$$5 \text{ m sec} \geqq \beta.$$

3. The microscopic droplet detecting device of claim 1, wherein when $\alpha n$ represents the time obtained by dividing the distance between a center of a top droplet and a center of a last droplet which compose a droplets group with an average speed of the droplet, $\alpha n$ satisfies the following formula:

$$5 \text{ m sec} \geqq \alpha n \geqq 0.5L/V.$$

4. The microscopic droplets detecting device of claim 1, wherein the jet control section can change the number of the droplets which compose the group of serial droplets.

5. The microscopic droplet detecting device of claim 4, wherein the jet control section changes the number of the droplets which compose the group of serial droplets, in accordance with the level of the output signal that is detected by the droplet detecting section.

6. The microscopic droplet detecting device of claim 4, wherein the jet control section changes the number of the droplets which compose the group of serial droplets, in accordance with the type of the microscopic droplets.

7. The microscopic droplet detecting device of claim 6, comprising:

a discriminating section to discriminate the type of the microscopic droplet jetted from the nozzle, wherein the jet control section changes the number of the droplets which compose the group of serial droplets, in accordance with the type of the microscopic droplet that is discriminated by the discriminating section.

8. The microscopic droplets detecting device of claim 6, comprising:

a table in which the relationship between the kind of the microscopic droplet and the number of the droplets composing the group of serial droplets according to the type is memorized in advance, wherein the jet controlling means changes the number of the droplets which compose the group of serial droplets, in accordance with the table.

9. The microscopic droplet detecting device of claim 6, wherein the type of the microscopic droplets is either one of a color, density, viscosity, temperature characteristics, and component of the microscopic droplet.

10. A microscopic droplet detecting device for detecting a passage of droplets jetted from a nozzle of an ink jetting device, comprising:

a droplet detecting section including a paired light emitting and receiving elements which are arranged such that the light emitting element emits a light flux so as to cross a traveling course of the droplets jetted from the nozzle and the light receiving element receives a detecting light flux among the emitted light flux, wherein a detecting area of the detecting light flux corresponds to a light receiving area of the light receiving element;

a jet control section to control the ink jetting device to jet droplets serially along the traveling course in such a way that serial droplets simultaneously exist in a form of group in the detection area of the detecting light flux so that the droplet detecting section detects the group of serial droplets and outputs an output signal representing the group of serial droplets; and a jetting condition detecting section to detect a jetting condition of the nozzle based on the output signal;

wherein the jet control section controls the ink jetting device to jet plural groups of serial droplets so as to satisfy the following formula:

$$5 \text{ m sec} \geqq \alpha n \geqq 0.5L/V$$

where $\alpha n$ represents the time obtained by dividing the distance between a center of a top droplet and a center of a last droplet which compose a droplets group with an average speed of the droplet, L is a distance (m) of the detecting area of the detecting light flux along the traveling course of droplets, and V is a speed (m/sec) of a droplet when the droplet passes over the detecting area of the detecting light flux.

11. The microscopic droplet detecting device of claim 10, wherein the jet control section can change the number of the droplets which compose the group of serial droplets.

12. An ink-jet recording apparatus for conducting the recording on a recording medium by jetting microscopic droplets of ink from a nozzle of a recording head, comprising a droplet detecting section including a paired light emitting and receiving elements which are arranged such that the light emitting element emits a light flux so as to cross a traveling course of the droplets jetted from the nozzle and the light receiving element receives a detecting light flux among the emitted light flux, wherein a detecting area of the detecting light flux corresponds to a light receiving area of the light receiving element;

a jet control section to control the ink jetting device to jet droplets serially along the traveling course in such a way that serial droplets simultaneously exist in a form of group in the detecting area of the detecting light flux so that the droplet detecting section detects the group of serial droplets and outputs an output signal representing the group of serial droplets; and a jetting condition detecting section to detect a jetting condition of the nozzle based on the output signal;

wherein the jet control section controls the ink jetting device to jet plural groups of serial droplets so as to satisfy the following formula:

$$\beta \geq L/V$$

where

β is a suspension time period (m sec) between a preceding group of serial droplets and a following group of serial droplets, L is a distance (m) of the detecting area of the detecting light flux along the traveling course of droplets, and V is a speed (m/sec) of a droplet when the droplet passes over the detecting area of the detecting light flux.

13. The ink-jet recording apparatus of claim 12, wherein β satisfies the following formula:

$$5 \text{ m sec} \geq \beta.$$

14. The ink-jet recording apparatus of claim 12, wherein when αn represents the time obtained by dividing the distance between a center of a top droplet and a center of a last droplet which compose a droplets group with an average speed of the droplet, αn satisfies the following formula:

$$5 \text{ m sec} \geq \alpha n \geq 0.5L/V.$$

15. The ink-jet recording apparatus of claim 12, wherein the jet control section can change the number of the droplets which compose the group of serial droplets.

16. The ink-jet recording apparatus of claim 15, wherein the jet control section changes the number of the droplets which compose the group of serial droplets, in accordance with the level of the output signal that is detected by the droplet detecting section.

17. The ink-jet recording apparatus of claim 15, wherein the jet control section changes the number of the droplets which compose the group of serial droplets, in accordance with the type of the microscopic droplets.

18. The ink-jet recording apparatus of claim 17, comprising:

a discriminating section to discriminate the type of the microscopic droplet jetted from the nozzle, wherein the jet control section changes the number of the droplets which compose the group of serial droplets, in accordance with the type of the microscopic droplet that is discriminated by the discriminating section.

19. The ink-jet recording apparatus of claim 17, comprising:

a table in which the relationship between the kind of the microscopic droplet and the number of the droplets composing the group of serial droplets according to the type is memorized in advance, wherein the jet controlling means changes the number of the droplets which compose the group of serial droplets, in accordance with the table.

20. The ink-jet recording apparatus of claim 17, wherein the type of the microscopic droplets is either one of a color, density, viscosity, temperature characteristics, and component of the microscopic droplet.

21. An ink-jet recording apparatus for conducting the recording on a recording medium by jetting microscopic droplets of ink from a nozzle of a recording head, comprising:

a droplet detecting section including a paired light emitting and receiving elements which are arranged such that the light emitting element emits a light flux so as to cross a traveling course of the droplets jetted from the nozzle and the light receiving element receives a detecting light flux among the emitted light flux, wherein a detecting area of the detecting light flux corresponds to a light receiving area of the light receiving element;

a jet control section to control the ink jetting device to jet droplets serially along the traveling course in such a way that serial droplets simultaneously exist in a form of group in the detection area of the detecting light flux so that the droplet detecting section detects the group of serial droplets and outputs an output signal representing the group of serial droplets; and a jetting condition detecting section to detect a jetting condition of the nozzle based on the output signal;

wherein the jet control section controls the ink jetting device to jet plural groups of serial droplets so as to satisfy the following formula:

$$5 \text{ m sec} \geq \alpha n \geq 0.5L/V$$

where

αn represents the time obtained by dividing the distance between a center of a top droplet and a center of a last droplet which compose a droplets group with an average speed of the droplet, L is a distance (m) of the detecting area of the detecting light flux along the traveling course of droplets, and V is a speed (m/sec) of a droplet when the droplet passes over the detecting area of the detecting light flux.

22. The ink-jet recording apparatus of claim 21, wherein the jet control section can change the number of the droplets which compose the group of serial droplets.

* * * * *